United States Patent [19]

Ureche

[11] Patent Number: 4,689,524

[45] Date of Patent: Aug. 25, 1987

[54] FLUORESCENT LAMP BALLAST

[76] Inventor: Alexander Ureche, 12712 Greene Ave., Los Angeles, Calif. 90066

[21] Appl. No.: 784,287

[22] Filed: Oct. 4, 1985

[51] Int. Cl.[4] ..... H05B 37/02

[52] U.S. Cl. ..... 315/206; 315/97; 315/99; 315/219; 315/222

[58] Field of Search ..... 315/208, 209 R, 206, 315/219, 99, 97, 105, 222, 200 R

[56] References Cited

U.S. PATENT DOCUMENTS

| | | | |
|---|---|---|---|
| 2,264,055 | 11/1941 | Stocker | 315/98 |
| 3,579,026 | 5/1971 | Paget | 315/99 |
| 3,707,648 | 12/1972 | Rosa | 315/231 |
| 3,889,153 | 6/1975 | Pierce | 315/101 |
| 4,008,414 | 2/1977 | Agnew | 315/97 |
| 4,017,761 | 4/1977 | Woldring | 315/244 |
| 4,129,805 | 12/1978 | Sherman | 315/206 |
| 4,167,689 | 9/1979 | Quirke | 315/206 |
| 4,220,896 | 9/1980 | Paice | 315/205 |
| 4,286,194 | 8/1981 | Sherman | 315/209 R |
| 4,288,724 | 9/1981 | Sherman | 315/219 |
| 4,320,325 | 3/1982 | Anderson | 315/205 |
| 4,327,308 | 4/1982 | Hwang et al. | 315/99 |
| 4,331,905 | 5/1982 | Owen | 315/225 |
| 4,430,628 | 2/1984 | Nilssen | 315/256 |
| 4,453,109 | 6/1984 | Stupp et al. | 315/219 |
| 4,484,108 | 11/1984 | Stupp et al. | 315/219 |
| 4,503,361 | 3/1985 | Hanlet | 315/219 |

*Primary Examiner*—Harold Dixon

*Attorney, Agent, or Firm*—Nilsson, Robbins, Dalgarn, Berliner, Carson & Wurst

[57] ABSTRACT

An electronic fluorescent lamp ballast having at least an energy storing component, a controlling component which has two states, and two socket elements which enables the filaments of the fluorescent lamp to be connected in series with the energy storing component. A constant current flows through a portion of the energy storing component when the controlling component is in one state producing an "energy latching" effect which will enable the ballast to achieve a very high efficiency of energy transfer. The ballast also has a self adjustable frequency of operation as a function of lamp impedance variation due to age and enables constant ionization within the fluorescent lamp.

6 Claims, 10 Drawing Figures

FLUORESCENT LAMP BALLAST

BACKGROUND AND SUMMARY OF THE INVENTION

Fluorescent lamps have replaced incandescent lamps for lighting purposes in many areas because the fluorescent lamps provide an equal or greater amount of visible light while consuming less energy compared to the incandescent type. A current, commercial fluorescent lamp generally comprises a long tube containing a drop of mercury, a small amount of argon gas and electrodes sealed into each end of the lamp. Additionally, the fluorescent lamp has filaments on its opposite ends. The inner surface of the tube is coated with a light emitting substance usually fluorescent or phosphorescent metallic salts. The lamp emits light when an electrical arc is created through the argon gas and mercury. This arc produces a large amount of ultraviolet light radiation, in the invisible range of the light spectrum. The ultraviolet light radiation then strikes the fluorescent substance to emit radiation having a longer wavelength. The generation of the arc is due to the ionization of the argon gas which requires that a high voltage called the breakdown voltage be applied between the electrodes. Once started, only a low maintaining voltage is necessary to maintain the ionization process. Thus, the breakdown voltage is necessary to start or ignite the fluorescent lamp while the maintaining voltage is necessary to maintain the ionization within the fluorescent lamp. If the voltage between the electrodes decreases below the maintaining voltage, the argon gas within the fluorescent lamp begins to deionize and the current through the lamp eventually drops to zero. The deionization time is generally twenty to forty microseconds during which the current through the lamp will decay considerably slower than the voltage. Therefore, the current will lag the voltage. Additionally, after the voltage between the electrodes has become zero there will still be a current through the lamp for a few microseconds.

A fluorescent lamp requires an element which will initially provide the breakdown voltage and thereafter limit the current through the lamp. This element is called a ballast and could be constructed with an inductor and switch. A more sophisticated circuit could be constructed by using active elements. The simple ballast is not very expensive but produces a low efficiency of energy transfer. The sophisticated ballast is usually expensive, not very reliable, and capable of producing electromagnetic interferences. Additionally, the high voltage that persists even when the lamp is removed poses a measure of danger to safety.

The electronic ballast includes a first and second socket for electrically engaging the lamp filaments, and an energy storing component for storing energy from the voltage source and selectively transmitting energy to the lamp. Additionally, the ballast includes a component for controlling the transmission of energy to the lamp with the controlling component having a first state for enabling energy to be stored in the energy storing component and enabling energy to be transmitted from the voltage source to the lamp, and a second state for enabling the energy stored in the energy storing component to be transmitted to the lamp whereby the transmission of energy from the voltage source to the lamp is prevented. The first socket is connected between the voltage source and the energy storing component, and the second socket is connected between the energy storing component and the controlling component so that the filaments are connected in series to the energy storing component. The energy storing component and controlling component cause the generation of the breakdown voltage to ignite the fluorescent lamp when the lamp is not ignited and the controlling component is in the second state. Additionally, the energy storing component enables constant current to flow through a portion of the energy storing component when the lamp is ignited and the controlling component is in the second state. This enables the present invention to consume very little energy, thereby increasing the efficiency of energy transfer to the lamp.

Because ballasts of the present invention utilize only small number of electronic components, the costs for the ballast are very low. Additionally, the present invention produces low electromagnetic interferences and enables the voltage across the lamp to be equal to or less than the maintaining voltage after the lamp has ignited. In fact, the voltage across the lamp drops to zero if the lamp is removed thereby providing protection against electrical shock.

DETAILED DESCRIPTION OF THE PREFERRED EMBODIMENT

Generally, an electronic ballast operates as an on/off switch which alternately connects and disconnects the voltage source to the flourescent lamp. This switching process by the ballast determines the frequency of operation; the faster the ballast switches on and off the higher will be the frequency of operation.

The present invention is an electronic ballast which saves more energy than previos ballasts. A higher power factor is achieved by providing a circuit which consumes more powwer than previous ballast circuits. The present invention separates the primary winding of a transformer to four distinct windings. When the lamp is connectred to the circuit, it is parallel with one of these windings. This allows the current through the lamp to be higher than the current provided by the power source thereby yielding a more efficient circuit. Previous ballast circuits provided a current through the lamp which was smaller than the current provided by the power source.

Once the lamp has ignited, the present invention limits the current to the lamp by using inductance which is known to be a non-dissapative element. The inductance is provided by the transformer windings. Previous ballasts utilized resistive elements to limit the current. This resulted in power being dissipated by the reistive element thereby limiting the power consumed by the circuit.

Figure 1:
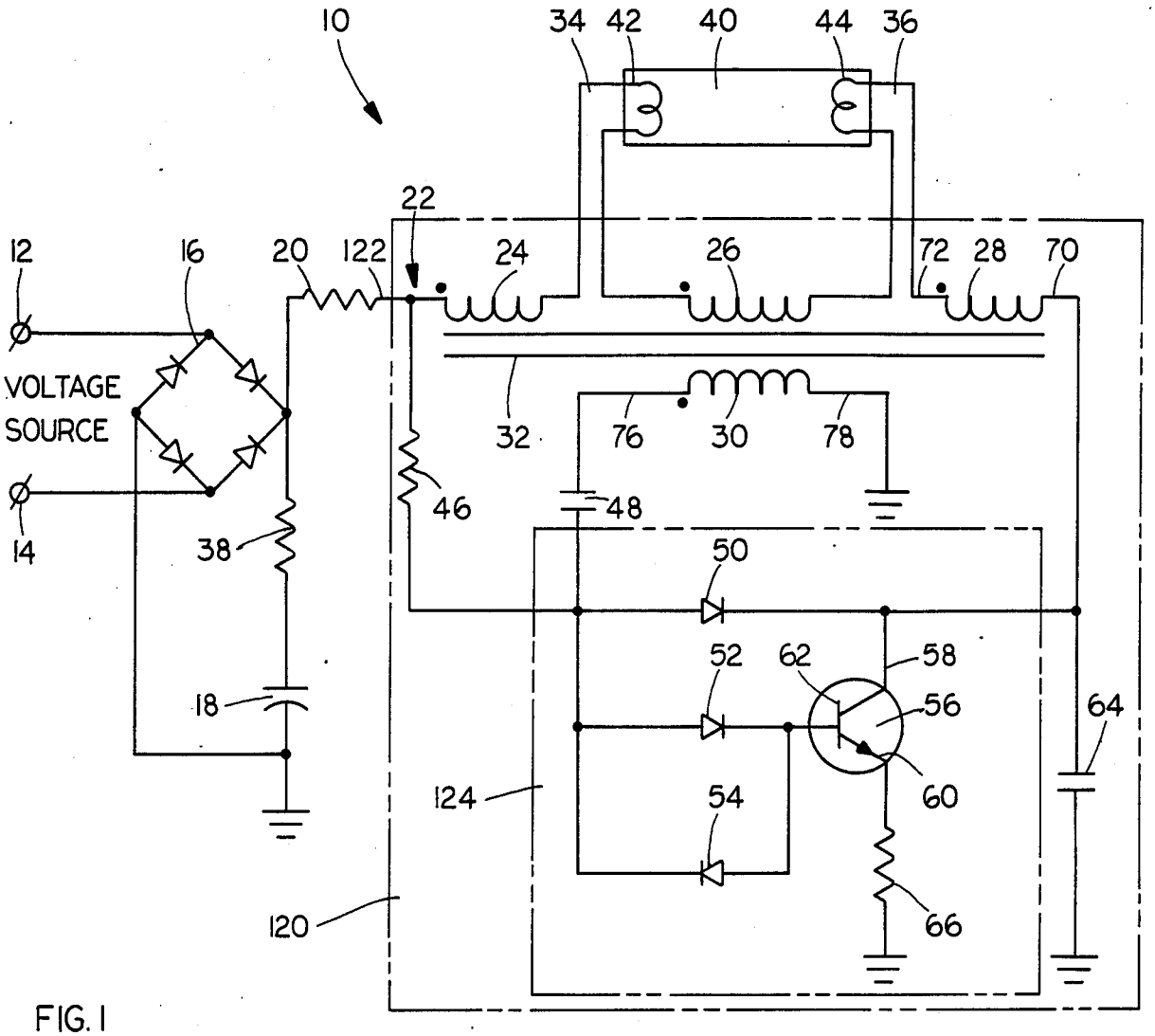
FIG. 1 is a circuit diagram of the present invention.
Figure 2:
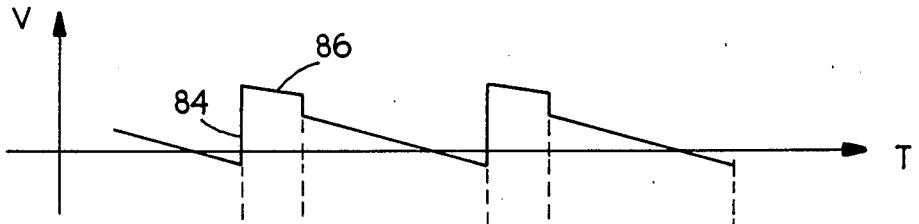
FIG. 2 illustrates the waveform generated by the second capacitor in the present invention.

Referring to FIG. 1, the electronic ballast 10 includes a pair of terminal elements 12 and 14 connected to a voltage source. A rectifier bridge 16 is then connected to the terminal elements 12 and 14 to rectify an AC voltage. A first resistor 20 is connected to the rectifier bridge 16 and to a transformer 22 so as to limit the current to the transformer which comprises a first winding 24, a second winding 26, a third winding 28, a fourth winding 30 and a core 32. The first transformer winding 24 has one end connected to the first resistor 20 and the other end connected to a first socket element 34 to enable current to pass through the first socket element when the lamp is connected to the ballast. The second transformer winding 26 is connected to the first socket element 34 and a second socket element 36 so as to enable energy to be transmitted to the lamp. The third transformer winding 28 is also connected to the second socket element 36 to provide a constant current through the third winding 28 thus "latching" a portion of the energy stored in the transformer. A first capacitor 18 is connected to the rectifier bridge 16 and to ground to provide filtering for the rectified AC voltage and to enable the ballast to recover the energy "latched" by the third winding. A second resistor 38 is connected between the rectifier bridge 16 and the positive end of the first capacitor 18 to provide a higher power factor to the circuit. The power factor being the ratio of power consumed by a circuit to the power taken from a voltage source.

A fluorescent lamp 40 having a first filament 42 and a second filament 44 disposed on its opposite ends is electrically connected to the electronic ballast through the first and second socket elements 34 and 36, respectively. When the lamp is connected to the sockets, first and second filaments are in series with first winding 24, second winding 26 and the third winding 28, and the fluorescent lamp 40 appears in parallel with the second winding 26. A third resistor 46 is connected to a point between the first resistor 20 and the first winding 24. The third resistor 46 is also connected to a second capacitor 48 the combination of which determines how long energy is to be transmitted from the transformer to the lamp. The second capacitor 48 is also connected to the fourth winding 30 which provides feedback in the ballast circuit. Further, the fourth winding has its other end connected to ground. The anodes of a first diode 50 and second diode 52 are connected to the third resistor 46, while the cathode of the first diode 50 is connected to the collector 58 of an npn transistor 56 and the cathode of the second diode 52 is connected to the base 62 of the transistor so as to provide maximum frequency of operation of the ballast. The anode of a third diode 54 is connected to the base 62 of the transistor and is parallel to but in opposite direction with the second diode 52. A third capacitor 64 has one end connected to the third winding 28 and has its other end connected to ground thus, reducing any radio frequency interference to the ballast. A fourth resistor 66 is connected between the emitter 60 of the transistor and ground thereby producing a negative feedback in the ballast circuit for stabilizing the temperature reaction of the transistor.

The dots shown in the drawings at one end of each of the transformer windings signify the polarity of the windings. That is, if any voltage change occurs at the dotted end of any winding, a proportional voltage change with the same sign will be reflected to the other windings at the dotted ends.

The transistor 56 functions as a switch and controls the energy applied to the fluorescent lamp 40. The electronic ballast of the present invention ignites the fluorescent lamp 40 by the following operation. Referring to FIGS. 2 through 8 the time period whereby the transistor 56 is "on" is shown as 80, and the time period whereby the transistor 56 is "off" is shown as 82. Recall that a very high voltage across the lamp is necessary for the lamp to be ignited. Specifically, a voltage equal to or greater than the breakdown voltage is necessary. A current from the voltage source will pass through the rectifier bridge 16, the first resistor 20 and and will divide into two seperate currents, one passing through the first winding 24 the second passing through the third resistor 46. The current through the first winding 24 will then pass through the first filament 42 then through the second winding 26, the second filament 44 and through the third winding 28. The current passing through the first and second filaments allow them to preheat which enables the lamp to ignite faster. A portion of the current passing through the third resistor 46 will ultimately reach and rapidly charge the second capacitor 48 as seen at 84 in FIG. 2. The second capacitor begins to discharge immediately after it has been fully charged and is shown at 86.

Another portion of the current passing through the second resistor 46 will reach the base 62 of the transistor 56 thereby turning the transistor "on". When the transistor turns "on", it enters the saturation region. For this particular circuit, the value of the second capacitor 48 is fairly high and the time which the transistor is "on" is very small. Therefore, during this small period of time, the current discharged from the second capacitor to the base 62 of the transistor is constant and the current through the base 62 ($I_B$) of the transistor 56 is also constant. Additionally, the voltage source and the inductance of the four windings of the transformer enables the current through the collector 58 ($I_C$) to increase linearly while the second capacitor 48 is discharging.

Figure 3:
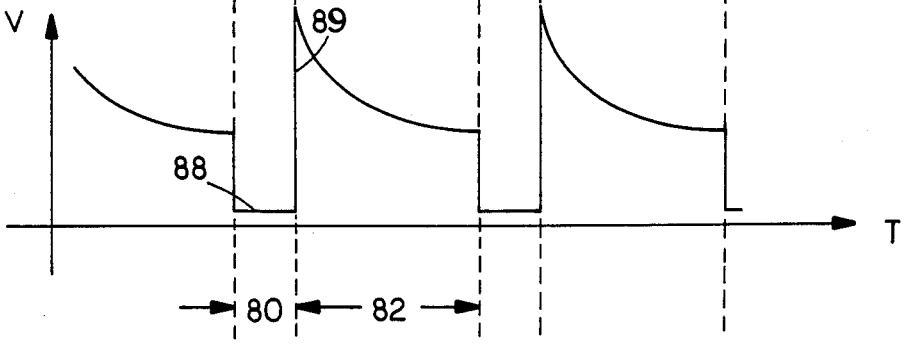
FIG. 3 illustrates the waveform generated at the collector of the transistor in the present invention.

Generally, for any BJT transistor the ratio $I_C/I_B$ is called beta which is usually a small number while the transistor is in the saturation region and $I_C/I_B$ increases as the transistor approaches the active region. In the instant case since IC increases while $I_B$ remains constant, $I_C/I_B$ increases Eventually, $I_C/I_B$ will increase to a level such that the transistor 56 enters the active region. Referring to FIG. 3, the voltage at the collector ($V_C$) remains constant while the transistor is "on" as shown as 88. However, the moment the transistor 56 enters the active region, the voltage at the collector 58 ($V_C$) slightly increases which causes the voltage at end 70 of the third winding 28 to also increase. $V_C$ slightly increases between the "on" period 80 and the "off" period 82 and appears to be instantaneous as shown at 89. However, the response of this element and all the elements in the circuit is not instantaneous, but requires a finite amount of time but is very small relative to time periods 80 or 82. The decrease of voltage at end 70 causes the voltage from end 72 to end 70 to decrease as seen at 90 in FIG. 4 which shows the response for both the third and fourth windings 28 and 30 at ends 72 and 76 respectively. The waveform of the two windings are exactly the same but the magnitudes are different. The decrease in voltage across the third winding effects the voltage across the other windings and, in particular, the voltage across the fourth winding from end 76 to end 78 decreases. The decrease in voltage across the fourth winding 30 causes the voltage at the base 62 ($V_B$) to also decrease and is seen at 92 in FIG. 5.

Since the voltage at the emitter 60 remains constant, the voltage from base 62 to emitter 60 ($V_{BE}$) decreases. Generally, if the voltage from the base to emitter decreases the voltage from collector to emitter ($V_{CE}$) increases. In the present invention, a decrease in $V_{BE}$ results in an increase in $V_{CE}$ which, in turn, causes $V_C$ to increase further.

Since the above described process started when $V_C$ increased, the process is repeated. The second winding 26, third winding 28 and fourth winding 30 provides a positive feedback circuit in the ballast thereby enabling the regenerative process to be repeated until $V_B$ decreases to a negative value which will enable the transistor 56 to turn "off". When the transistor 56 turns "off", the equivalent inductance of the series combination of the first winding 24, second winding 26 and third winding 28 will react by generating a very high voltage spike which is divided proportionally to the number of turns of the first, second and third windings. The voltage spike across the second winding 26 will be equal to or greater than the breakdown voltage. When the transistor 56 is "off" the current drained from the voltage source will be very small and will be utilized only to first discharge then to charge the second capacitor 48. By discharging and charging the second capacitor 48, $V_B$ slowly increases as shown at 96 in FIG. 5. Eventually, $V_B$ will increase to a positive value which will cause the transistor 56 to turn back "on" wherein $V_B$ will remain constant as shown at 98. Due to the voltage spikes generated when the transistor 56 turns "off", the on/off action of the transistor 56 will result in the ionization within the fluorescent lamp 40 and therefore ignite the lamp.

If the core 32 of the transformer 22 saturates, the inductance of the transformer will decrease by a large amount thereby producing a large current through transistor 56 which is an undesireble effect. Therefore, the transformer core must be prevented from saturation. An increase in resistance while havin9 a constant voltage will, of course, result in a decrease in current. Therefore, before the lamp 40 has ignited and while the transistor 56 is "on", the current through the windings of the transformer is decreased by the first resistor 20. By maintaining the current through the windings at a low value, the core will not saturate.

If a transistor is deeply in the saturation region it will take more time for the transistor to reach the active region and will cause the transistor 56 to remain "on" for a longer period of time thereby using more energy from the voltage source. The transistor 56 remains "on" for the shortest period of time by allowing the transistor to reach only the incipient point of saturation, i.e., the point whereby the transistor is still in the saturation region but very close to the active region. In the instant case when the transistor 56 is "on" the collector current ($I_C$) equals a value such that if the voltage from the collector 58 to the base 62 ($V_{CB}$) is greater than zero, then the transistor 56 will move further into the saturation region. However, if $V_{CB}$ is equal to zero, then the transistor 56 will be at the incipient point By connecting the first diode 50 and second diode 52 as shown in FIG. 1, $V_{CB}$ will be equal to zero while transistor 56 is "on". Therefore, by utilizing diode 50 and 52 as shown in FIG. 1, transistor 56 remains "on" for a short period of time thereby efficiently using energy from the voltage source and yielding a high frequency of operation. If diodes 50, 52 and 54 are replaced by electrical conductors, the ballast will still operate. However, the operating frequency will be lower therefore, the efficiency of energy transfer will be lower.

Once the fluorescent lamp 40 has ignited the transistor 56 switches "off" and "on" by the same process as described above. From this point forward, the fluorescent lamp is to be considered ignited. If the voltage across the fluorescent lamp 40 is less than the maintaining voltage and the ionization within the lamp is small, the voltage and current across the lamp will exhibit a fairly linear relationship. This ratio between the, voltage and current is the thermionic resistance of the lamp. Therefore, the lamp will behave resistively.

When the voltage across the lamp is equal to or greater than the maintaining voltage, the ionization within the lamp is very high and the electrical arc is formed in the lamp. If the voltage across the lamp then decreases below the maintaining voltage, deionization will begin. Deionization is not instantaneous therefore, the number of ions within the lamp will gradually decrease usually following an exponential curve. Additionally, the voltage and current across the lamp will no longer exhibit a fairly linear relationship. In fact, the current decay through the lamp will lag the voltage decay across the lamp. Since an inductor is the electrical element whereby the current lags the voltage, the lamp will behave inductively The equivalent inductance of the lamp is usually quite high and is mainly determined by the rated power of the lamp which is given by the manufacturer, and the shape of the lamp. Referring back to the electronic ballast in FIG. 1, the turn winding ratio of the second winding 26 to the third winding 28 is chosen such that the voltage across the fluorescent lamp is just below the maintaining voltage when the transistor 56 is "on" Therefore, when the transistor 56 is "on" the fluorescent lamp 40 behaves resistively and is parallel to the second winding 26.

Figures 4, 5, 6, 7, 8:
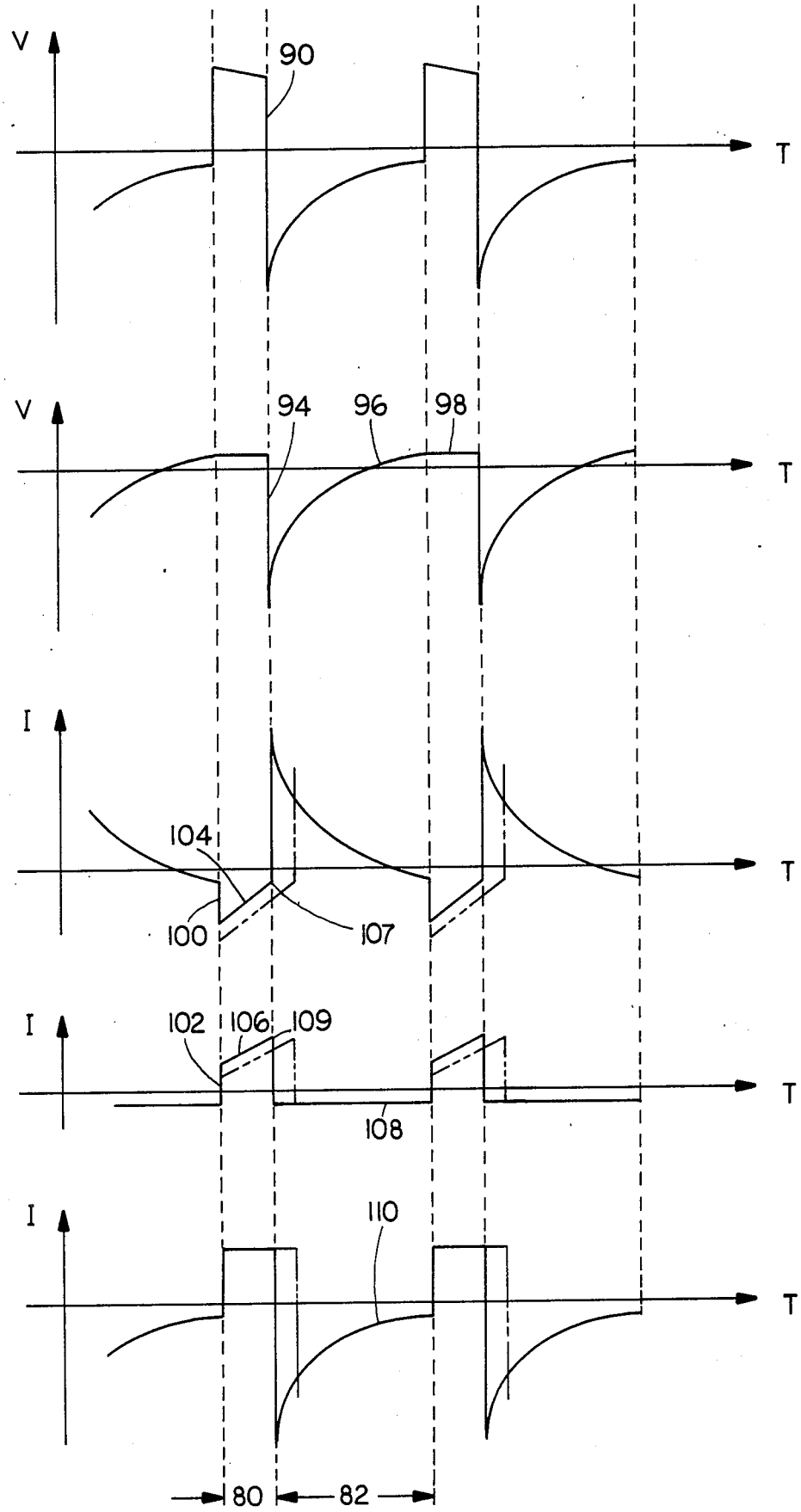
FIG. 4 illustrates the waveform generated by the third and fourth windings of the transformer in the present invention.
FIG. 5 illustrates the waveform generated at the base of the transistor in the present invention.
FIG. 6 illustrates the waveform generated by the second winding of the transformer in the present invention.
FIG. 7 illustrates the waveform generated by the third winding of the transformer in the present invention.
FIG. 8 illustrates the waveform generated by the lamp in the present invention.

The magnitude of the vertical portion 100 of the current response through the second winding 26 shown in FIG. 6 and the magnitude of the vertical portion 102 of the current response through the third winding 28 shown in FIG. 7 is determined by the fluorescent lamp 40 which acts as a resistance when the transistor 56 is "on". The linearly increasing portion 104 and 106 of FIGS. 6 and 7, respectively, have a slope which is determined by the inductance of the series combination of first winding 24, second winding 26 and third winding 28. The current through the lamp shown in FIG. 8 is the sum of the current through the second winding shown in FIG. 6 and the current through the third winding shown in FIG. 7. As the fluorescent lamp 40 ages filaments 42 and 44 emits a lower amount of electrons, thus the filaments become weaker. This requires a longer time period for the transistor 56 to remain "on" and causes the resistance of the lamp to decrease. If the resistance decreases, the linear portion 104 and 106 will begin at a lower point. However, the slope of the linear portion 104 and 106 will remain the same. Additionally, the current level when the transistor switches from "on" to "off" called the "switching point" 107 and 109 also will remain the same. FIGS. 6 and 7 show in phantom that the time which the transistor 56 remains "on" is longer. Referring to FIG. 8 in phantom, the time which the transistor 56 remains "on" must also be longer. Thus, the present invention provides an electronic ballast having a self-adjustable frequency of operation according to the age of the lamp.

The core 32 of the transformer 22 must be prevented from saturation for the reasons as described above when the lamp 40 was not ignited. However, the method of avoiding the core saturation is different once the lamp has ignited. In a parallel RLC circuit whereby the R (resistance) is parallel to only a portion of L (inductance), the currents through the two portions of the inductance will flow in opposite directions. However, this will only occur if the current through the series combination of the two portions of the inductance is not greater than the current through the resistance. In the instant case, if the current through the first winding 24, second winding 26 and third winding 28 is not greater than the current through the lamp 40, the current through the second winding 26 and the third winding 28 will flow in opposite directions. If the currents through the second winding and third winding flow in opposite directions the net current through the transformer 22 will be low thus preventing the core 32 from saturating.

The winding turn ratio of the second winding 26 to the third winding 28 is chosen such that once the lamp has ignited and the transistor 56 is "on" the voltage across the lamp 40 is just below the maintaining voltage which produces a small amount of ionization and enabling the lamp to behave resistively. However, when the transistor is "off" the voltage across the lamp will exceed the maintaining voltage thereby producing an electrical arc for a short time and high ionization within the lamp. After the arc and high ionization have occured, the voltage across the lamp will decrease. Thus, when the transistor is "off" the lamp behaves inductively for the reasons described above. Additionally, the number of turns of the second winding 26 and the third winding 28 is chosen such that the inductance of the second winding and third winding are much less than the equivalent inductance of the lamp. Due to the high inductance reflected by the lamp when the transistor is "off", the current through the third winding 28 will remain relatively constant and is shown as 108 in FIG. 7. Although FIG. 7 shows the current as constant, there is a decrease. However, the decrease in current is very small relative to time period 82.

Referring to FIG. 8, while the transistor is "off" the current shown at 110 never reaches zero thereby preventing the lamp from extinguishing or becoming completely deionized. The time period which the transistor remains "off" is determined by the third resistor 46 and second capacitor 48. By properly chosing values of the third resistor 46 and second capacitor 48 the transistor 56 is turned "on" before the current through the lamp equals zero. Additionally, since the current through the third winding remains constant while the transistor is "off", not all of the energy stored in the third winding is utilized. In fact, when the transistor switches "on" the energy remaining in the third winding is transferred to the first capacitor 18. Therefore, all of the energy accumulated by the transformer 22 while the transistor is "on" is not transferred to the lamp when the transistor is "off" but a portion of the energy is saved by the third winding and is recovered for use when the transistor switches "on" again. This saving of energy will hereinafter be called the "energy latching" effect.

The energy latching effect is due to the following reasons. The lamp 40 behaves as an inductance much bigger than the second winding 26 and third winding 28 while the transistor 56 is "off". The ionization within the lamp is low while the transistor 56 is "on" thereby enabling the lamp 40 to behave resistively and allowing adequate energy to be stored by the transformer 22. The current through the second winding 26 and third winding 28 flow in opposite directions while the transistor 56 is "on". The third resistor 46 and second capacitor 48 is chosen such that the current from the fourth winding 30 is very low thereby enabling the current through the third winding 28 to remain constant. The proper selection of a winding turn ratio of the third winding 28 to the second winding 26.

The energy latching effect will last only while the lamp is still ionized. Therefore, the time which the transistor is "off" should be limited to 20 to 40 microseconds which yields the operating frequency of the circuit to be 25 Khz and above.

Since the filaments 42 and 44 are connected in series when the lamp 40 is plugged into socket elements 34 and 36, respectively, removing lamp 40 from the socket elements will cause the voltage across the socket elements to be zero thereby providing a high safety feature. Additionally, even while the lamp 40 is plugged into the socket elements the voltage across the lamp will not be greater than the maintaining voltage further providing safety.

The first winding 24 enables the current to flow through both filaments 42 and 44 while the transistor 56 is "off". If the first winding 24 is not utilized, then the current will only flow through the second filament 44 and the stray capacitances of the windings.

Figure 9:
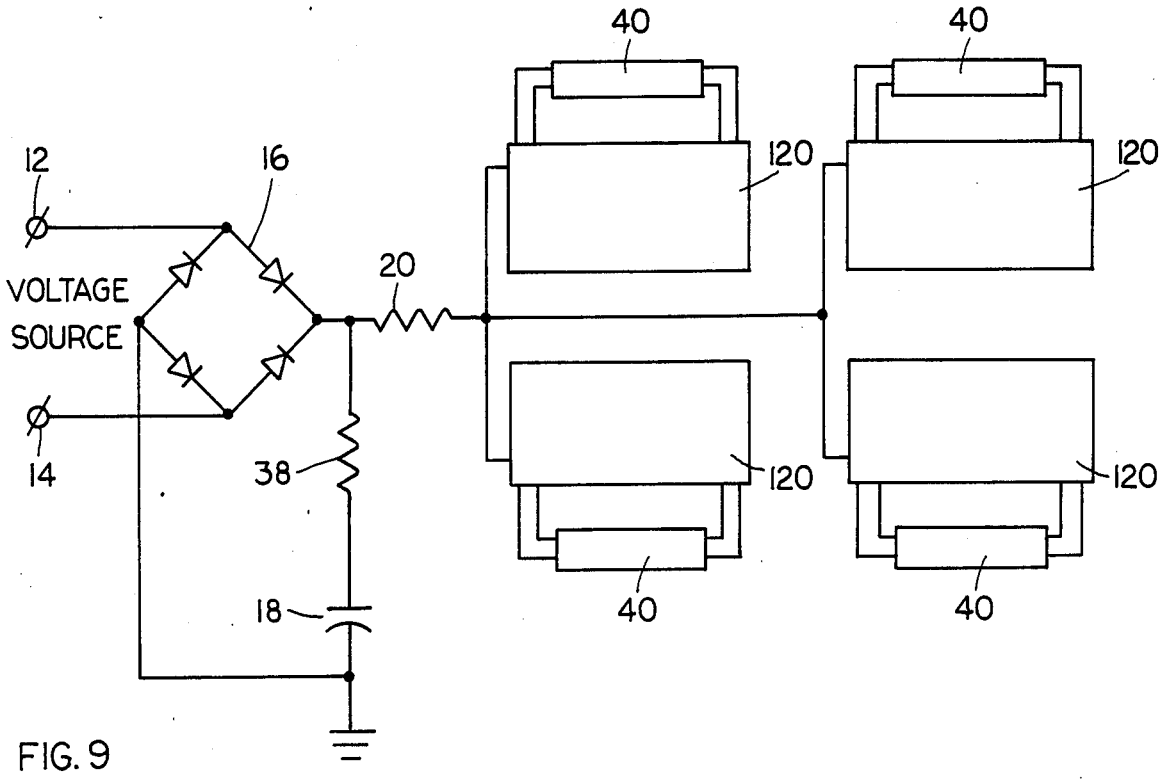
FIG. 9 illustrates an alternate embodiment of the present invention for four lamps.

The present invention has been shown to operate only one fluorescent lamp thus far. Referring to FIG. 1, if all the components within enclosure 120 shown in phantom lines are duplicated and connected to end 122 of first resistor 20, the present invention may operate more than one fluorescent lamp. FIG. 9 shows four enclosures 120 connected to end 122 of first resistor 20 thereby enabling the present invention to operate four fluorescent lamps.

An even less expensive version of the circuit could be accomplished by eliminating diodes 50,52 and 54 within enclosure 124 shown in FIG. 1. The second and third diodes 52 and 54, respectively, are replaced by a short circuit while the first diode 50 is removed thereby leaving an open circuit. A fifth resistor 126 having a very low value relative to the fourth resistor 46 is connected between the base 62 of the transistor 56 and ground. The value of the fifth resistor 126 is also several times smaller than the input impedance of the transistor, and the fifth resistor will appear in

Figure 10:
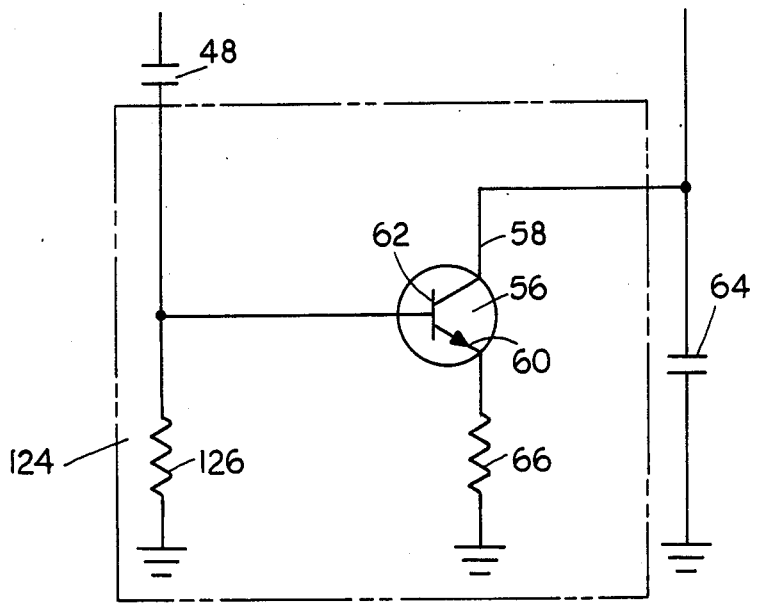
FIG. 10 illustrates another embodiment of the present invention substituting for the diodes shown in FIG. 1.

18. parallel to the input impedance of the transistor. Therefore, the capacitor 48 discharges through an impedance which is considerably lower than with the previous circuit. Consequently, the discharging time of the capacitor will be shorter than before thereby yielding a higher frequency of operation (over 100 KHz). As in the previous circuit, transistor 56 will be prevented from entering deep saturation because the base current is only a fraction of the discharging current from capacitor 48. This is because most of the discharging current from capacitor 48 passes through the fifth resistor 126. Therfore, by utilizing the circuit as shown in FIG. 10, the cost of the circuit is reduced and the frequency of operation is increased thereby raising the efficiency of the circuit.

From the foregoing, it has been shown that the present invention provides an electronic ballast for fluorescent lamps which provides further energy saving, a self-adjustable frequency of operation as a function of the change of lamp impedance due to age and it provides an energy latching effect. Although a specific embodiment of the invention has been illustrated and described, various modifications and changes may be made without departing from the spirit and scope of the invention. For example, replacing the third resistor 46 with a potentiometer will enable the ballast circuit to dim the light input from the lamp. Additionally, replacing the first resistor 20 with a thermistor provides further current limiting protection for the ballast. Also, the second resistor 38 may alternatively be connected between the positive end of the voltage source and the rectifier bridger 16. A one-diode rectifier can replace the four diode rectifier bridge 16. Furthermore, although the lamp 40 shown in FIG. 1 is straight shaped, the present invention will function equally well utilizing U-shaped or circular shaped fluorescent lamps.

What is claim is:

1. An electronic ballast having at least a first and second terminal for engaging the filaments of at least one fluorescent lamp which requires a breakdown voltage to ignite the lamp and a maintaining voltage for maintaining ionization therewithin, the electronic ballast comprising:

a direct current voltage source;

a transistor;

a transformer having a primary winding separated into a first winding, a second winding, a third winding, and a fourth winding;

said first winding connected between said voltage source and the first terminal;

said second winding connected between the two terminals;

said third winding connected between the second terminal and to both said transistor and to ground;

said fourth winding connected between ground and said transistor;

the lamp being parallel to said second winding when the lamp filaments engages the ballast terminals; and the winding turn ratio of said third winding to said second winding has a predetermined value such that while the fluorescent lamp is ignited and said transistor is on, the fluorescent lamp voltage is below the maintaining voltage and the ionization of space in the fluorescent lamp is low, therefore the lamp behaves resistively and the frequency of operation of the ballast adjusts to the change of lamp impedance due to age.

2. The electronic ballast of claim 1 wherein:

the winding turn ratio of said third winding to said second winding has a predetermined value such that while said transistor is off, the fluorescent lamp voltage equals the maintaining voltage and decreases thereafter;

the ionization in the lamp when said transistor is off is greater than the ionization in the lamp when said transistor is on, therefore the lamp behaves inductively;

the equivalent lamp inductance is much greater than the inductance of said second winding;

said third winding transmits constant current to the lamp when said transistor is off; and a portion of energy stored in said third winding is recovered when said transistor changes from off to on.

3. The electronic ballast of claim 1 wherein said direct current voltage source is a rectifier bridge connected to an alternate current voltage source.

4. The electronic ballast of claim 1 further comprising:

current limiting means for preventing the core of said transformer from saturating when said lamp is not ignited and said transistor is on:

said current limiting means being connected in series between said voltage source and said first terminal: and said fourth winding being connected in series between a capacitor and ground.

5. The electronic ballast of claim 1 wherein said third winding and said second winding has a winding turn ratio of predetermined value such that the current through said second winding and said third winding to flow in opposite directions to prevent the core of said transformer from saturating when said fluorescent lamp is ignited and said transistor is on.

6. The electronic ballast of calim 1 wherein said electronic ballast further includes:

means for allowing said transistor to reach only the incipient point of saturation thereby preventing said transistor from operating far into the saturation region; and a resistive capacitive network for determining how long said transistor remains off, whereby said transistor switches from off to on before the electrical current through said fluorescent lamp reaches zero thereby maintaining constant ionization in the fluorescent lamp after the fluorescent lamp is ignited.

* * * * *